United States Patent [19]

Beaumont

[11] Patent Number: 4,648,805

[45] Date of Patent: Mar. 10, 1987

[54] AIR COMPRESSOR WITH PRELOADED CLUTCH

[75] Inventor: Paul Beaumont, Gwent, United Kingdom

[73] Assignee: Grau Girling Limited, Blackburn, England

[21] Appl. No.: 715,464

[22] Filed: Mar. 25, 1985

[30] Foreign Application Priority Data

Mar. 30, 1984 [GB] United Kingdom ..... 8408227
Jul. 26, 1984 [GB] United Kingdom ..... 8419062

[51] Int. Cl.[4] ..... F04B 49/08

[52] U.S. Cl. ..... 417/223; 192/85 AA; 192/91 A

[58] Field of Search ..... 192/91 A, 85 AA; 417/223, 319

[56] References Cited

U.S. PATENT DOCUMENTS 3,047,115 2/1962 Lee et al. ..... 192/85 AA
3,266,608 8/1966 Lemieux ..... 192/85 AA
4,440,282 10/1981 Ishimaru et al. ..... 192/85 AA

FOREIGN PATENT DOCUMENTS 2125114 2/1984 United Kingdom .

*Primary Examiner*—Carlton R. Croyle
*Assistant Examiner*—Theodore W. Olds
*Attorney, Agent, or Firm*—Holman & Stern

[57] ABSTRACT

An air compressor having a piston driven via a crankshaft from an input shaft by means of a multi-plate clutch which is normally held in engaged condition by a spring device. The clutch and spring device are contained within a housing which includes a retainer placed, after the spring device has been pre-loaded to a desired extent, in a position determined by said pre-loading and secured in that position to maintain the spring device in pre-loaded state. The crankshaft is housed within a crankcase and passages interconnect the interiors of the crankcase and clutch housing, with the casing ends of the passages at a higher level than a predetermined permissible oil level for the crankcase. This permits crankcase pressure during operation to expel oil from the crankcase along the passage into the clutch casing, while limiting the height to which oil may accumulate in the crank case when the piston is stationary.

8 Claims, 5 Drawing Figures

AIR COMPRESSOR WITH PRELOADED CLUTCH

This invention relates to an air compressor primarily for use in a vehicle air-actuated braking system, and being of the kind having at least one compressor element operable by drive means to effect compression of air within a space, the compressed air usually being fed, in use, to a reservoir and thence on demand to the braking system for actuation of the latter.

In FIG. 1 of Published U.K. patent application No. 2,125,114A there is described a compressor of the aforesaid general kind and including a clutch device for transmitting drive from the drive means to the compressor element when compression is required. The clutch is normally held in engagement by a spring device and is disengagable by a device responsive to a pressure resulting from the compressor output to interrupt the drive to the compressor element when said pressure reaches a predetermined value. With such an arrangement, it is desirable for the spring device to be set to a predetermined pre-load in order that the clutch may operate satisfactorily over a range of operating conditions. Because of manufacturing tolerances in the other clutch components, it is often difficult, in practice, to achieve the desired pre-load in the spring device with the required degree of accuracy. Such expedients as shims have been proposed to take up excess tolerances, but these are time consuming to assemble and not, therefore, cost effective.

An object of the invention is to provide an air compressor of the aforesaid general kind in which the aforesaid problem is alleviated.

According to the invention, an air compressor comprises at least one compressor element operable by drive means to effect compression of air within a space, a clutch for transmitting drive from the drive means to the compressor element when compression is required, and a spring device operable normally to urge the clutch into engagement, the clutch and spring device being contained within a housing which includes a retainer placed, in a position determined by pre-loading of the spring means and secured in that position to maintain the spring device permanently in a pre-loaded state.

In one convenient arrangement, the clutch is of the multi-plate type having interleaved driving and driven plates of which the driving plates are rotatable with a drive input shaft, the housing conveniently being longitudinally slotted to form fingers of which the free end portions are connected together by said retainer. Said driven plates may conveniently be keyed to the housing for rotation therewith by portions thereof inserted between said fingers.

Preferably, the clutch is lubricated by oil supplied under pressure through drillings in a crankshaft associated with the compressor element. Oil leakage can occur into the surrounding crankshaft enclosure or crankcase and in order to prevent excessive build-up of oil in the crankcase, the interiors of the crankcase and a further enclosure, such as a casing containing the clutch are interconnected by a passage of which the casing end is at a level higher than a predetermined permissible oil level for the crankcase, the arrangement being such that the crankcase pressure during operation of the mechanism is applied to expel oil from the crankcase along said passage into the clutch housing.

In one convenient arrangement, said passage is formed in the respective walls of the crankcase and clutch casing, the passage including a portion rising upwardly into the clutch casing and terminating in a weir over which oil from the crankcase spills into the clutch casing.

The invention will now be described, by way of example, with reference to the accompanying drawings.

Figure 1:
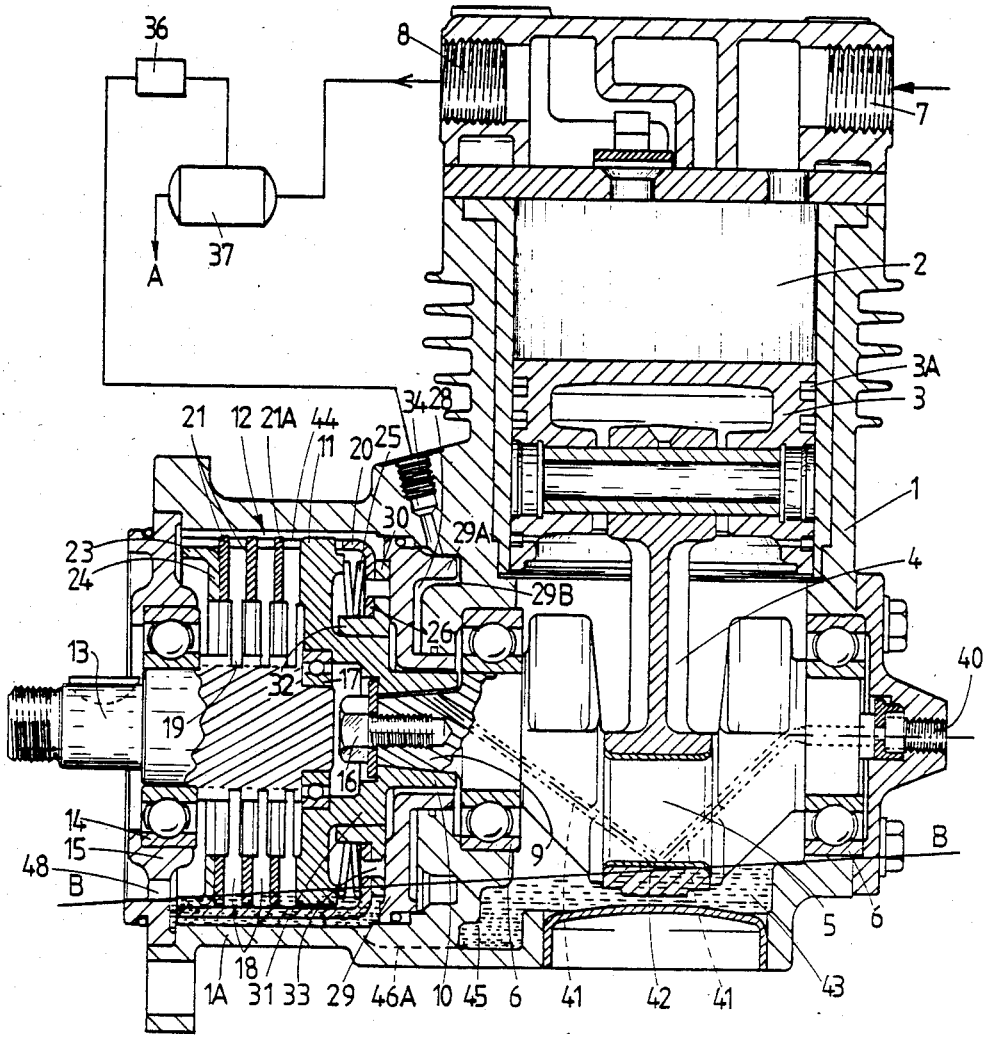
FIG. 1 is a longitudinal cross-section of one embodiment of the air compressor of the invention.

Referring to FIG. 1 of the drawings, the compressor illustrated therein is primarily intended for use with a vehicle air-actuated braking system, of which a part is illustrated diagramatically. The compressor comprises a housing 1 defining a cylinder 2 within which slides a piston 3, coupled by a connecting rod 4 to a crank shaft 5 supported in bearings 6 mounted in the housing. As indicated by the arrows, air enters the cylinder during the induction stroke of the piston via an inlet port 7 and leaves the cylinder via an exhaust port 8, air flow through the ports being controlled by reed or other suitable valves, in conventional manner. The housing 1 has a generally cylindrical portion 1A forming a clutch housing.

The crank shaft 5 has a tapered extension 9 which is received within a hollow internally tapered boss 10 of a first clutch member 11 forming part of a clutch, indicated generally at 12, by which drive is transmitted to the crank shaft 5 from a drive input shaft 13 rotatably supported in a bearing 14 mounted in an end cap 15 of the housing 1. The clutch member 11 is retained firmly on the tapered extension 9 of the crank shaft by means of a bolt 16 and is supported relative to the drive input shaft 13 by means of a bearing 17.

The clutch 12 is illustrated as a multi-plate clutch, which may be dry or oil immersed, and which includes a plurality of driving clutch plates 18, contained within a hollow clutch member 20 which surrounds the clutch plates and is rotatable with the crank shaft 5. The clutch plates 18 are mounted on the drive input shaft 13 by way of splines 19 so as to be fast for rotation with and axially slidable along the drive input shaft 13. The clutch further includes a plurality of driven plates 21 interleaved with the driving plates 18 and being fast for rotation with but axially slidable relative to the clutch member 20. The portion of the clutch member 20 surrounding the clutch plates is formed as a plurality of axially extending fingers 22 (FIG. 2) and radially extending projections 21A of the clutch plates 21 extend within the gaps formed between adjacent pairs of fingers to provide the rotational connection between the clutch plates 21 and clutch member 20. The free end portions of the fingers 22 are secured together by an axially extending circular flange 23 of an end member 24 which, in the case illustrated, is welded in position to retain and effectively encapsulate the clutch plates 18 and 21 within the clutch member 20. For the sake of clarity, the plates 18 are omitted from FIG. 2 and only one of the plates 21 is illustrated.

The clutch plates are normally clamped firmly in driving engagement with the clutch members 11 and 20 by means of a conical disc spring washer assembly 25 acting between the side of the clutch member 11 remote from the clutch plates and the opposed internal surface of a radially extending wall 26 of the clutch member 20.

The housing 1 forms a chamber 28 containing an annular piston 29 slidable therein, the piston acting via a thrust member 30 on the outer surface of the wall 26 of the clutch member 20. The thrust member 30 is mounted on an intermediate boss 31 of the clutch member 11 by means of a sleeve portion 32 of the thrust member, which latter is made fast for rotation with the clutch member 20 by means of rivets 33. An air inlet port 34 to the chamber 28 is connected by way of a governor valve 36 to a reservoir 37 connected to the outlet port 8 of the compressor. The reservoir would normally be connected via a line A to one or more brake actuators (not shown) of a vehicle braking system, in conventional manner.

In order to achieve correct operation of the clutch, it is desirable to pre-load the conical washer assembly 25 as accurately as possible and one of the major advantages of the present invention is that it enables this to be done more accurately than hitherto and in a simple and convenient manner, during assembly of the clutch components. The first stage of assembly is to place the piston 29 within the chamber 28, with a tongue 29A of the piston engaged in a corresponding recess 29B of the housing to prevent rotation of the piston, in use.

A sub-assembly is created by first placing within the hollow clutch member 20, to which the thrust member 30 has been secured, the conical washer assembly 25 and clutch member 11, into which latter the bearing 17 has been press-fitted. The clutch plates 18 and 21 are then introduced, followed by the end member 24. The pre-load on the conical washer assembly 25 may now be set by applying an appropriate force to the end member 24 and, with this force still applied, permanently securing the end member 24 within the clutch member 20, as by welding for example. A completely encapsulated and accurately pre-loaded clutch assembly is thereby produced in a simple and inexpensive manner. This complete sub-assembly is now placed within the clutch housing 1A, the boss 10 being placed over the tapered extension 9 and secured in position by the bolt 16. The final steps are the addition of the drive input shaft 13 which is fed through the clutch plates to engage the plates 18 with the splines 19, and to engage in the bearing 17, this being followed by the assembly of the bearing 14 and end cap 15. If desired, the shaft 13, bearing 14 and end cap 15 may be pre-assembled as a sub-assembly prior to final assembly.

The drive input shaft 13 is continuously rotated, in use, by a power source such as the engine of a vehicle in which the compressor is installed. The chamber 28 is initially unpressurised and the conical washer assembly 25 clamps the clutch plates into firm engagement, enabling drive to be transmitted from the drive input shaft 13 via the clutch member 11 to the crank shaft extension 9, causing reciprocation of the piston 3 and charging of the reservoir 37. When the pressure within the reservoir reaches a predetermined value, the governor valve 36, which is responsive to the reservoir pressure, operates to apply the reservoir pressure to the chamber 28. The area of the piston 29 is chosen, in relation to the applied air pressure and force of the washer assembly 25, so that the reservoir pressure applied to the piston produces sufficient force to overcome the washer assembly 25 and thereby pushes the clutch member 20 to the left against the action of the washer assembly 25 to disengage the clutch. This interrupts the drive between the drive input shaft 13 and the compressor piston and prevents further charging of the reservoir until this is required according to the conditions of use. An important feature of this embodiment is that axial load arising from actuation of the piston 29 to disengage the clutch is transmitted via the clutch member 11, bolt 16 and crank shaft extension 9 to the adjacent crank shaft bearing 6, which means that the drive input shaft bearings are not subjected to axial load from this source and may be simple deep groove ball bearings, as illustrated. Since the crank shaft ceases to rotate shortly after the clutch is disengaged, the axially loaded crank shaft bearing 6 is not rotated, while so loaded, for a significant length of time.

As usage of the braking system takes place, the pressure in the reservoir will be progressively reduced and will ultimately reach a predetermined pressure at which the governor valve is set to operate to disconnect the reservoir from the chamber 28. This allows the pressure in this chamber to decay so that the clutch disengagement force exerted by the piston 29 is reduced, enabling the conical washer assembly 25 to re-exert a clutch engagement force.

During normal operation of a vehicle in which the system is installed, the cycle will be repeated to maintain the pressure in the reservoir 37 within a range between desired maximum and minimum pressures.

In order to minimise wear upon the thrust member 30, a flat is provided in an upper region of the crank shaft extension 9 to provide a gap 40 which communicates with an oil drilling 41 of the crank shaft 5 to enable oil to be supplied under pressure to the region of the bearing pad and thereby provide a cushion effect on the latter during transmission of force therethrough from the piston 29.

Lubrication of the clutch is effected from an oil inlet 40 via drillings 41 in the crankshaft 5, such drillings also providing lubrication for the big-end bearing 42 of the compressor. Inevitably, leakage takes place from the bearing 42 into the crankcase 43 and, in the event that this becomes excessive, a problem can arise due to splashing of the oil by the big-end bearing onto the piston 3 and leakage of oil past the piston rings 3A into the cylinder. This is undesirable since oil contamination of the compressed air can result.

Figure 2:
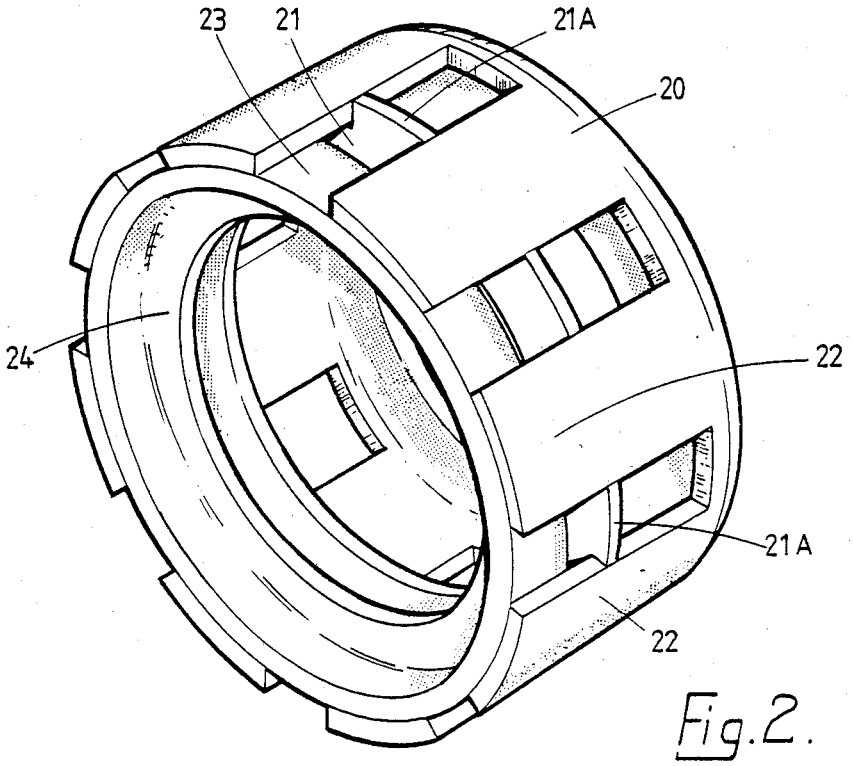
FIG. 2 is an enlarged perspective view of part of the compressor of FIG. 1.
Figure 4:
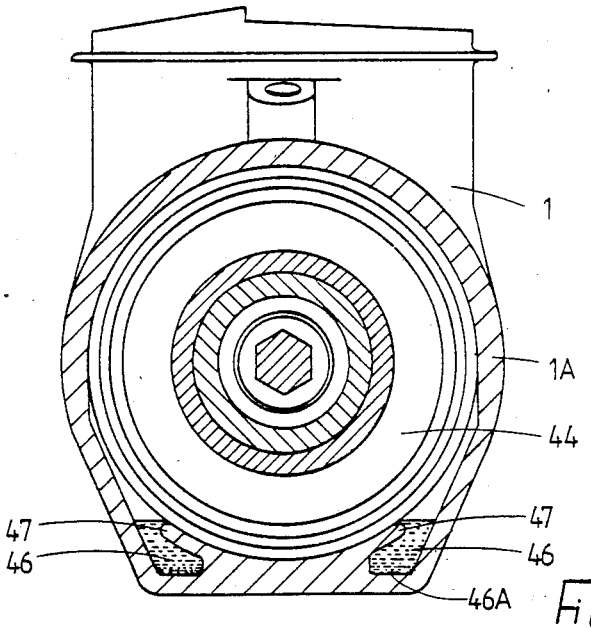
FIG. 4 is an end view, partly in section, of the compressor of FIG. 1.
Figure 3:
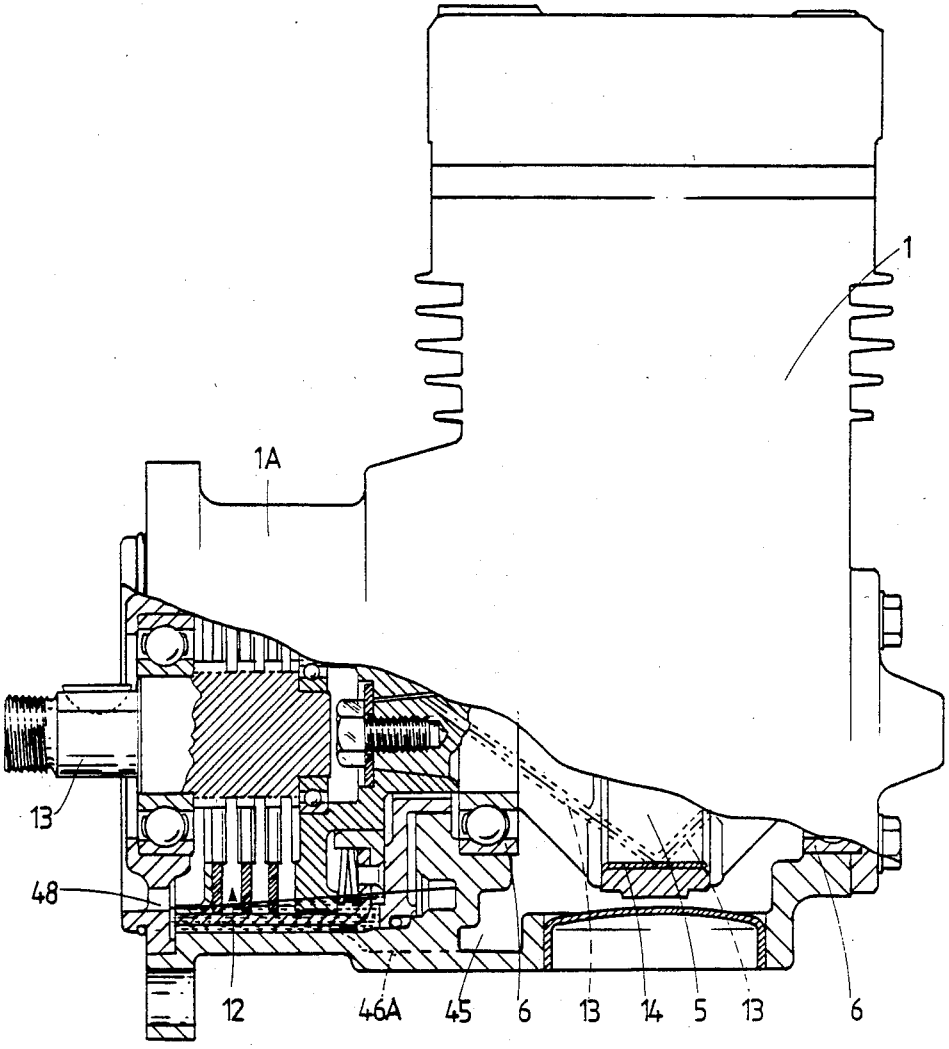
FIG. 3 is a view similar to FIG. 1, but only partly detailed, showing the compressor of FIG. 1 in an alternative condition.

In order to minimise this problem, passages are provided in the compressor housing 1 and the extension 1A thereof to enable oil deposited in the crankcase 43 to be transferred, during operation of the compressor into the clutch chamber 44 defined by the housing 1A. The housing 1 is provided with a recess 45 extending transversely thereof and, from the extremities of this recess, passages extend longitudinally through the housing 1 and then upwardly into the clutch housing 1A at either side thereof to desired positions relative to the clutch chamber 44. FIGS. 1 to 3 show a lower surface 46A of one passage 46, and from FIG. 4 it can be seen that these longitudinal passages 46 are partially defined by internal flanges 47 of the extension 1A which effectively form a weir, so that when the oil in the passages rises above the upper edge of the flanges 47, it spills into the clutch chamber 44 and drains back into the engine sump via slots 48 in the front of the clutch housing 1A.

When the compressor has been at rest for some time, oil may accumulate in the crankcase 43, but this is only allowed to reach a predetermined level which is indicated in the illustrated embodiment by the line B—B of FIG. 1. For reasons explained below this line is shown at 4° relative to the input shaft 13, and is at the level of the weir formed by the flanges 47. Any further oil entering the crankcase 43 will simply cause oil to flow over the weir, maintaining the oil level in the crankcase as shown. When the compressor piston starts to rotate, splashing may occur initially for a few revolutions, but pressure build-up in the crankcase will rapidly expel accumulated oil through the passages 46 and over the weir into the clutch chamber 44. The crankcase will then remain substantially free of excess oil, as illustrated in FIG. 3 until the piston becomes stationary once more.

It is sometimes necessary for the compressor to be installed in an attitude such that the rotational axis thereof is tilted by up to about 4° with the drive input shaft 13 then being slightly higher than the crankshaft 5. In order to ensure that oil does not accumulate in the crankcase 43 to an excessive level when such a tilted installation is carried out, the passages 46 are arranged to set a maximum desired oil level for the 4° tilt position; in the event that the compressor is installed with the rotational axis horizontal, the oil level in the crankcase in the stationary condirion will automatically be lower and within the desired limits.

It will be understood that the passages may take any convenient form and may be provided internally within the walls of the housing 1 and extension 1A, as shown, or externally thereof by the provision of one or more pipes. The clutch may, of course, be of any convenient oil-immersed type and the details of the compressor itself may be varied according to requirements.

Figure 5:
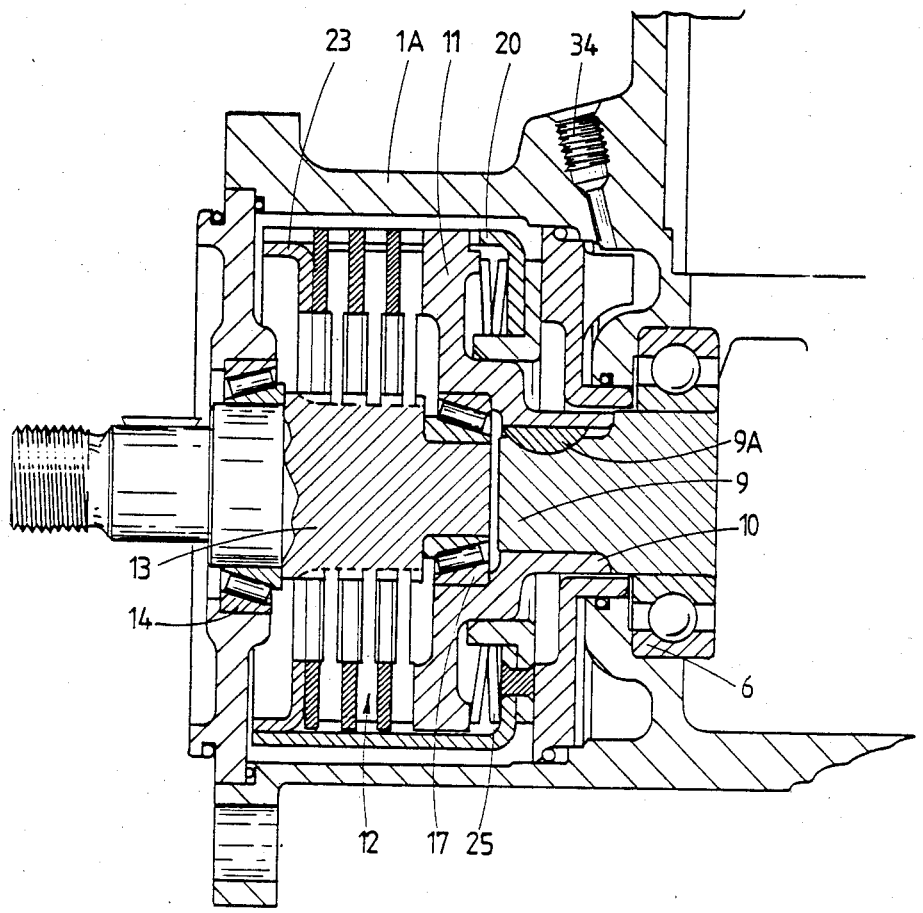
FIG. 5 is a view similar to FIG. 1 of part of an alternative form of the air compressor of the invention.

The embodiment illustrated in FIG. 5 of the drawings is generally similar to that of FIG. 1, the main difference being in the manner of connection of the clutch member 11 to the crank shaft extension 9. In this embodiment the extension 9 is no longer tapered, but provided wirh a key 9A which is engaged by an annular boss 10 of the clutch member 11 to render the latter fast for rotation with the crank shaft. In this arrangement, the axial thrust exerted by the compressor piston is no longer reacted by the adjacent compressor bearing 6, but rather by the bearings 14 and 17 which support the drive input shaft 13.

The bearings 14 and 17 are therefore of the tapered roller bearing type more suited to the reaction of axial thrust than those employed in the FIG. 1 embodiment. The air inlet 34 will be connected, in use, to a system similar to that illustrated in FIG. 1 and the general operation of the compressor is as described previously. Moreover, the clutch is encapsulated and provides a permanent pre-load on the conical washer assembly 25, as before.

It will be understood that all embodiments of the present invention, including that of FIG. 5, when equipped with an oil lubricated clutch, may incorporate the crankcase drainage arrangement described in relation to FIGS. 1 to 4.

I claim:

1. An air compressor comprising at least one compessor element operable by drive means to effect compression of air within a space, a clutch for transmitting drive from the drive means to the compressor element when compression is required, and a spring device operable normally to urge the clutch into engagement, the clutch and spring device being contained within a hollow clutch member which includes a retainer and means securing the retainer in a selected position determined by a desired pre-loading of the spring means so as to maintain the spring device permanently in the desired pre-loaded state.

2. An air compressor according to claim 1 wherein the clutch is of the multi-plate type having interleaved driving and driven plates of which the driving plates are rotatable with a drive input shaft.

3. An air compressor according to claim 2 wherein the hollow clutch member is longitudinally slotted to form fingers of which the free end portions are connected together by said retainer.

4. An air compressor according to claim 3 wherein said driven plates are keyed to the hollow clutch member for rotation therewith by portions thereof inserted between said fingers.

5. A clutch mechanism for use with a compressor in transmitting drive from a compressor drive means to a compressor element when compression is required, said mechanism including a spring device operable normally to urge components of the mechanism into an engaged condition, and a hollow clutch member containing the clutch components and spring device, said hollow clutch member including a retainer which was placed, in a selected position determined by desired pre-loading of the spring means and which was secured in the selected position to maintain the spring device permanently in the desired pre-loaded state.

6. A clutch mechanism according to claim 5 including weld means securing said retainer selected in said position.

7. A clutch mechanism according to claim 5 wherein the clutch components are of the multi-plate type including driving and driven plates, of which the driving plates are rotatable, in use, with a drive input shaft, the hollow clutch member being longitudinally slotted to form fingers of which the free end portions are connected together by said retainer.

8. A clutch mechanism according to claim 7 wherein of said driven plates are portions thereof inserted between said fingers.

* * * * *